US007614252B2

(12) United States Patent
De Lyrot

(10) Patent No.: US 7,614,252 B2
(45) Date of Patent: Nov. 10, 2009

(54) REVERSIBLE RING FOR PROVIDING TWO RINGS IN ONE FOR A FINGER OF A WEARER

(76) Inventor: Louis De Lyrot, 1 Main St., St. Thomas, VI (US) 00804-0400

( * ) Notice: Subject to any disclaimer, the term of this patent is extended or adjusted under 35 U.S.C. 154(b) by 0 days.

(21) Appl. No.: 11/810,775

(22) Filed: Jun. 7, 2007

(65) Prior Publication Data

US 2008/0302134 A1 Dec. 11, 2008

(51) Int. Cl.
*A44C 9/00* (2006.01)

(52) U.S. Cl. ..... 63/15.1; D11/34; 63/26; 63/28; 63/31; 63/40

(58) Field of Classification Search ..... None
See application file for complete search history.

(56) References Cited

U.S. PATENT DOCUMENTS 211,558 A * 1/1879 Edwards ..... 63/15
5,353,608 A * 10/1994 Berkowitz ..... 63/33
5,428,974 A * 7/1995 Shinohara ..... 63/15
D374,410 S * 10/1996 Tanory, Jr. ..... D11/34

* cited by examiner

*Primary Examiner*—Jack W. Lavinder
(74) *Attorney, Agent, or Firm*—Charles E. Baxley

(57) ABSTRACT

A reversible ring for providing two rings in one for a finger of a wearer. The ring includes a setting and at least one loop. The setting has a first side and a second side that is opposite to the first side of the setting. The setting shows a first display on the first side thereof and a second display on the second side thereof. The at least one loop circles the finger of the wearer, is pivotally connected to the setting, and is rotatable between a first position and a second position. The first display is positioned opposite to the finger of the wearer when the at least one loop is in the first position thereof, and the second display is positioned opposite to the finger of the wearer when the at least one loop is in the second thereof.

1 Claim, 5 Drawing Sheets

REVERSIBLE RING FOR PROVIDING TWO RINGS IN ONE FOR A FINGER OF A WEARER

1. BACKGROUND OF THE INVENTION

A. Field of the Invention

The embodiments of the present invention relate to a ring, and more particularly, the embodiments of the present invention relate to a reversible ring for providing two rings in one for a finger of a wearer.

B. Description of the Prior Art

Numerous innovations for rings have been provided in the prior art that will be described below, which are in chronological order to show advancement in the art, and which are incorporated herein by reference thereto. Even though these innovations may be suitable for the specific individual purposes to which they address, they each differ in structure, and/or operation, and/or purpose from the embodiments of the present invention, in that they do not teach a reversible ring for providing two rings in one for a finger of a wearer.

(1) U.S. Pat. No. 1,536,540 to Thomas.

U.S. Pat. No. 1,536,540 issued to Thomas on May 5, 1925 teaches a finger ring having annular oppositely facing edge portions defining a finger-receiving opening, a cavity between the edge portions at one side of the opening, and a key-hole formed in one of the edge portions and communicating with the cavity. The edge portion and key-hole are adapted to engage a key projecting from an annular edge portion of a secondary ring.

(2) U.S. Pat. No. 1,885,930 to Lowy.

U.S. Pat. No. 1,885,930 issued to Lowy on Nov. 1, 1932 teaches a removable and reusable sheathing over a ring, including a thermo-plastic, waterproof coating material that is molded or shaped into a contour corresponding to predetermined forms of the setting of rings. The molded material engages the ring in such a way as to permit the ring and sheathing to be removed as an assembly.

(3) U.S. Pat. No. 2,182,876 to Moldenhauer.

U.S. Pat. No. 2,182,876 issued to Moldenhauer on Dec. 12, 1939 in class 63 and subclass 15 teaches a ring having a continuous finger-contacting ring portion, a second section oscillatable with respect to the continuous ring portion and extending part of the circumference around the outside of the continues ring portion, a radially disposed pivot connecting the second portion to the continuous ring portion, and apparatus for holding the two portions in a nested position against accidental oscillation.

(4) U.S. Pat. No. Des. 343,590 to Dubs.

U.S. Pat. No. Des. 343,590 issued to Dubs on Jan. 25, 1994 in class D11 and subclass 26 teaches an ornamental design for a finger ring.

(5) U.S. Pat. No. 5,566,557 to Pasquetti.

U.S. Pat. No. 5,566,557 issued to Pasquetti on Oct. 22, 1996 in class 63 and subclass 15.2 teaches a finger ring including several annuli fastened together by a coupling device including a hook extending from a lateral face of a first annulus and designed for entering into a second annulus via an opening provided in one of its lateral faces and for cooperating with a coupling of this second annulus.

(6) U.S. Pat. No. 6,032,485 to Steinberg.

U.S. Pat. No. 6,032,485 issued to Steinberg on Mar. 7, 2000 in class 63 and subclass 15 teaches a piece of jewelry, like a ring, bracelet, or necklace containing a center opening, including a main body section taking the shape of the piece. This section has a channel extending around its side walls into which arms from covers are inserted. The covers overlay the main body section and slidably move over the main body section by way of the arms in the channels. In the preferred embodiment, two covers are provided on the main body section, although one or more than two covers are contemplated. The two covers slidably move in opposite directions on the main body section. The covers may have decorative ornamentation on their outer surfaces. When they are placed together and locked into position by a spring detent, the jewelry has one appearance. When the covers are together they also conceal and protect the gem, inscription, or other decorative ornamentation on the top surface of the main body section. When the covers are moved apart, they expose the decorative ornamentation on the top surface of the piece of jewelry, thereby presenting the piece with another appearance.

(7) U.S. Pat. No. 6,212,908 to Melas.

U.S. Pat. No. 6,212,908 issued to Melas on Apr. 10, 2001 in class 63 and subclass 15 teaches a jewelry ring having a main ring with two half-ring segments. Each of the ring segments has its own design. The design of the first ring segment is more prominent than the design of the second segment and is typically displayed to an outside viewer. When for security or any other reason the wearer rotates the ring, however, the second half with the less prominent design is displayed, thereby concealing the more prominent design of the first half without alerting a robber that a more prominent design is hidden.

(8) U.S. Pat. No. 7,073,351 to Baum et al.

U.S. Pat. No. 7,073,351 issued to Baum et al. on Jul. 11, 2006 in class 63 and subclass 15.3 teaches an engagement set including a wedding band and an engagement ring to which the wedding band is removably coupled. The shank of the wedding band, when joined together with the engagement ring, may be inclined relative to the shank of the engagement ring to form an "X" configuration and thereby symbolize a "kiss". The engagement set may be joined by a locking mechanism formed of a locking feature on the wedding band and a corresponding recess on the inner surface of the front of the engagement ring. The locking feature and the recess may have an emotionally symbolic shape, such as a heart shape or an "X". There may be an inclined groove at an inner surface of the back of the engagement ring to accommodate the shank of the wedding band when the rings are coupled together.

It is apparent that numerous innovations for rings have been provided in the prior art that are adapted to be used. Furthermore, even though these innovations may be suitable for the specific individual purposes to which they address, they would not be suitable for the purposes of the embodiments of the present invention as heretofore described, namely, a reversible ring for providing two rings in one for a finger of a wearer.

2. SUMMARY OF THE INVENTION

Thus, an object of the embodiments of the present invention is to provide a reversible ring for providing two rings in one for a finger of a wearer, which avoids the disadvantages of the prior art.

Briefly stated, another object of the embodiments of the present invention is to provide a reversible ring for providing two rings in one for a finger of a wearer. The ring includes a setting and at least one loop. The setting has a first side and a second side that is opposite to the first side of the setting. The setting shows a first display on the first side thereof and a second display on the second side of the setting. The at least one loop circles the finger of the wearer, is pivotally connected to the setting, and is rotatable between a first position and a second position. The first display is positioned opposite to the finger of the wearer when the at least one loop is in the first position thereof, and the second display is positioned opposite to the finger of the wearer when the at least one loop is in the second position thereof.

The novel features considered characteristic of the embodiments of the present invention are set forth in the appended claims. The embodiments of the present invention themselves, however, both as to their construction and their method of operation together with additional objects and advantages thereof will be best understood from the following description of the specific embodiments when read and understood in connection with the accompanying drawing.

3. BRIEF DESCRIPTION OF THE DRAWING

The figures of the drawing are briefly described as follows.

4. LIST OF REFERENCE NUMERALS UTILIZED IN THE DRAWING

Figure 1:
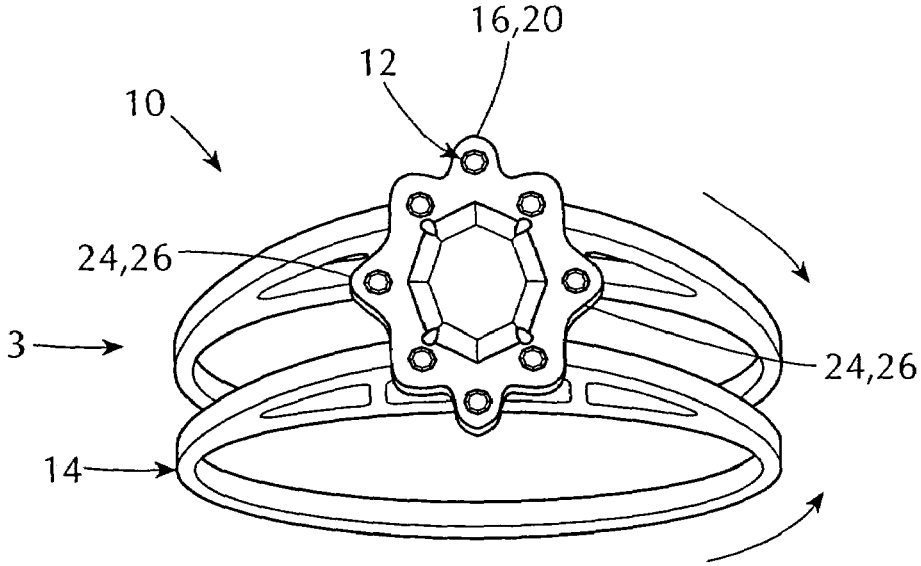
FIG. 1 is a diagrammatic perspective view of the reversible ring of the embodiments of the present invention displaying a first display on a first side of the setting.

A. General.

10 reversible ring of embodiments of present invention for providing two rings in one for finger (not shown) of wearer (not shown)

B. Overall configuration.

12 setting

14 at least one loop for encircling finger (not shown) of wearer (not shown)

16 first side of setting 12

18 second side of setting 12

20 first display of setting 12 for positioning opposite to finger (not shown) of wearer (not shown) when at least one loop 14 is in first position thereof

22 second display of setting 12 for positioning opposite to finger (not shown) of wearer (not shown) when at least one loop 14 is in second position thereof

24 pair of stops of setting 16

5. DETAILED DESCRIPTION OF THE PREFERRED EMBODIMENTS

A. General

Figure 2:
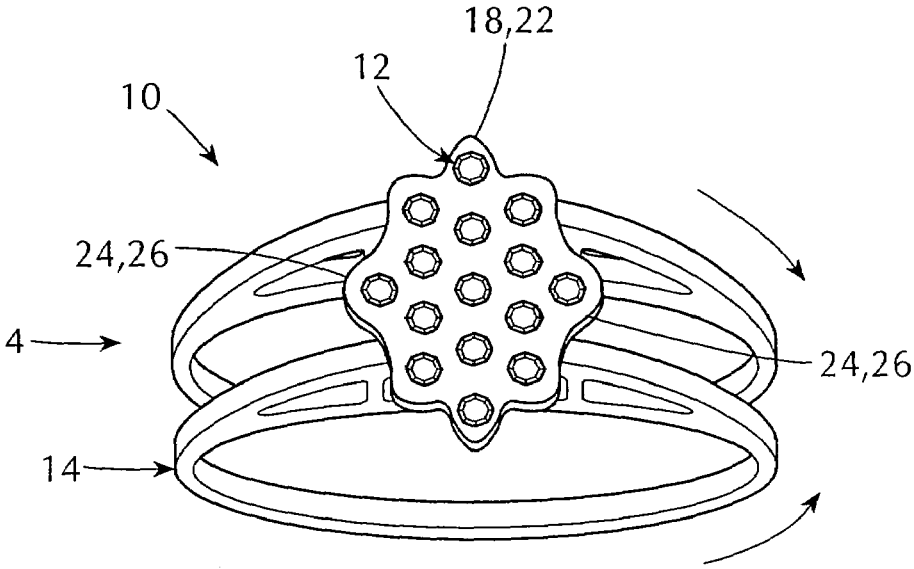
FIG. 2 is a diagrammatic perspective view of the reversible ring of the embodiments of the present invention displaying a second display on a second side of the setting.
Figure 3:
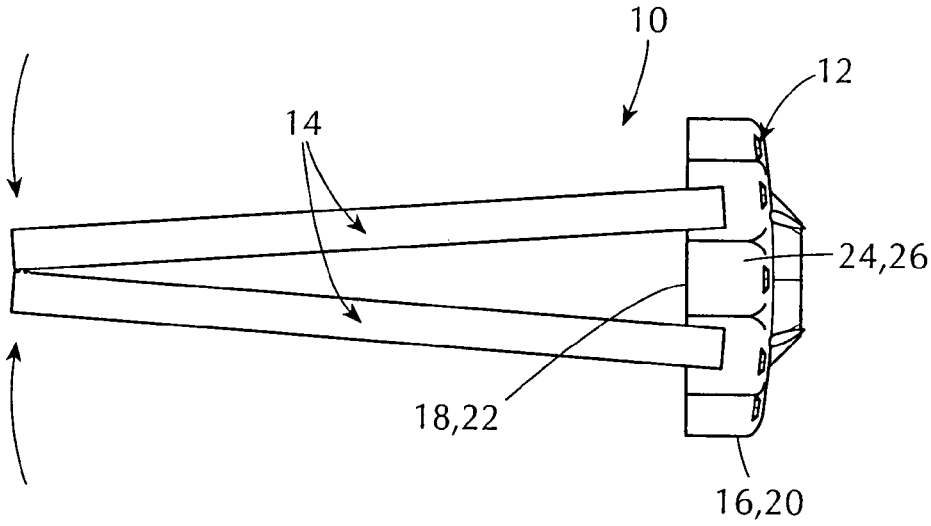
FIG. 3 is a diagrammatic side elevational view taken generally in the direction of ARROW 3 in FIG. 1.
Figure 4:
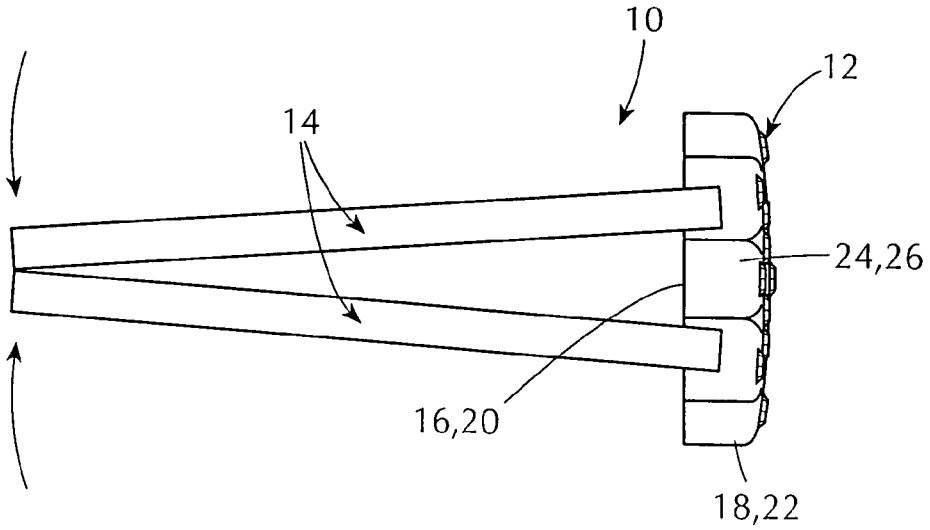
FIG. 4 is a diagrammatic side elevational view taken generally in the direction of ARROW 4 in FIG. 2.

Referring now to the figures, in which like numerals indicate like parts, and particularly to FIGS. 1 and 2, which are, respectively, a diagrammatic perspective view of the reversible ring of the embodiments of the present invention displaying a first display on a first side of the setting, and a diagrammatic perspective view of the reversible ring of the embodiments of the present invention displaying a second display on a second side of the setting, the reversible ring of the embodiments of the present invention is shown generally at 10 for providing two rings in one for a finger (not shown) of a wearer (not shown).

B. The Overall Configuration

Figure 5:
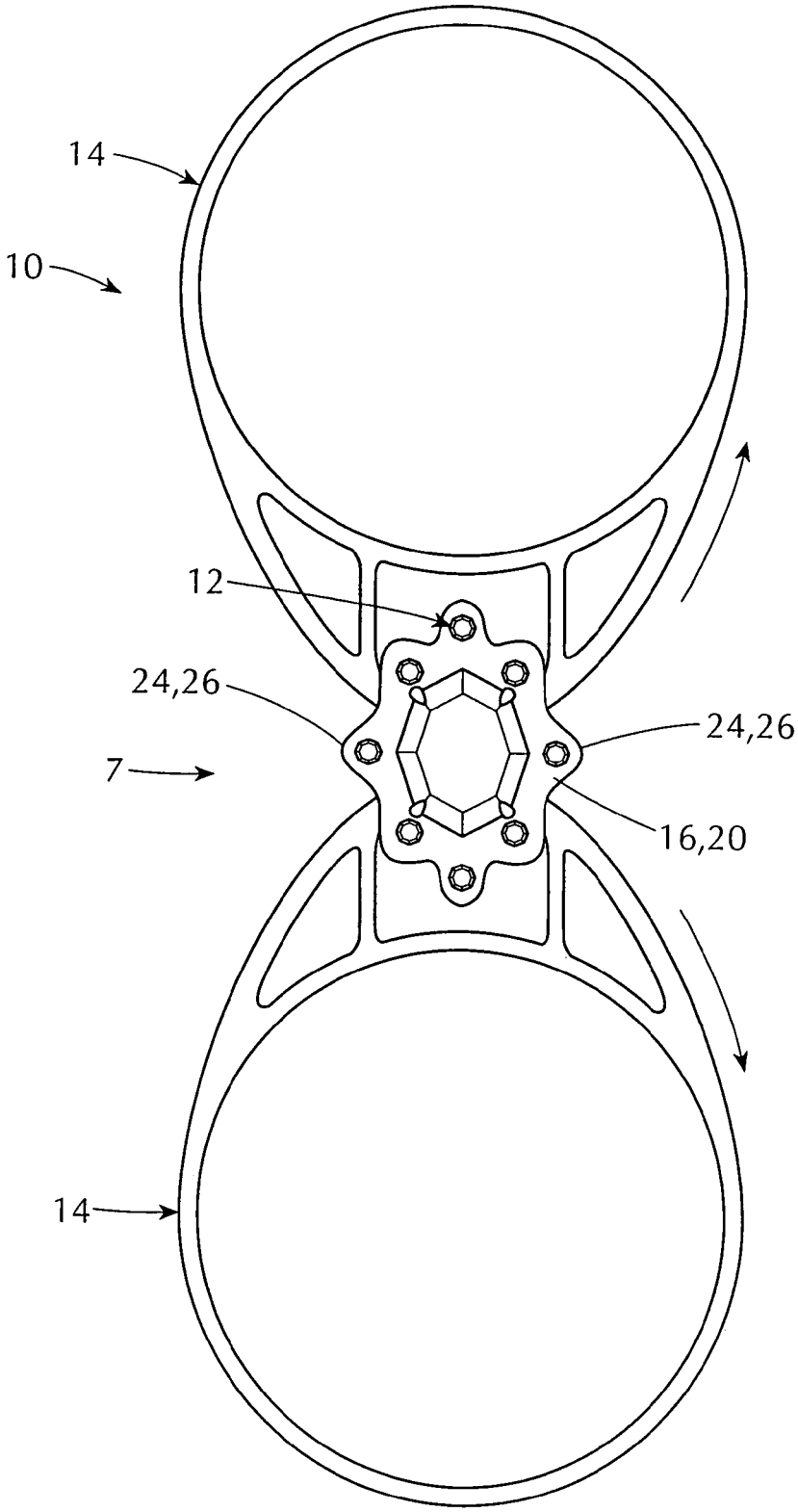
FIG. 5 is a diagrammatic front elevation view of the reversible ring of the embodiments of the present invention in an intermediate position and displaying the first display on the first side of the setting.
Figure 6:
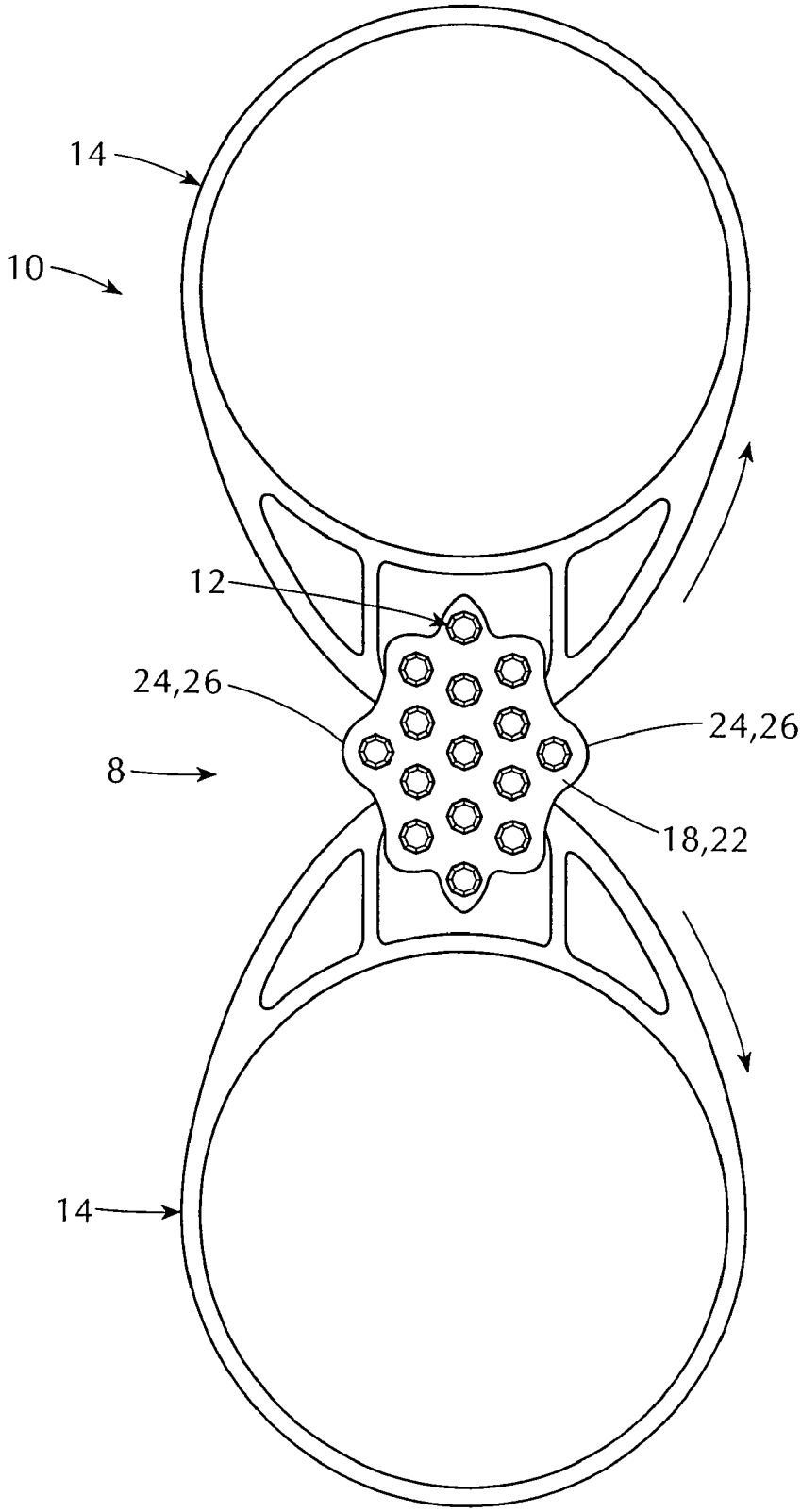
FIG. 6 is a diagrammatic front elevation view of the reversible ring of the embodiments of the present invention in an intermediate position and displaying the second display on the second side of the setting.
Figure 7:
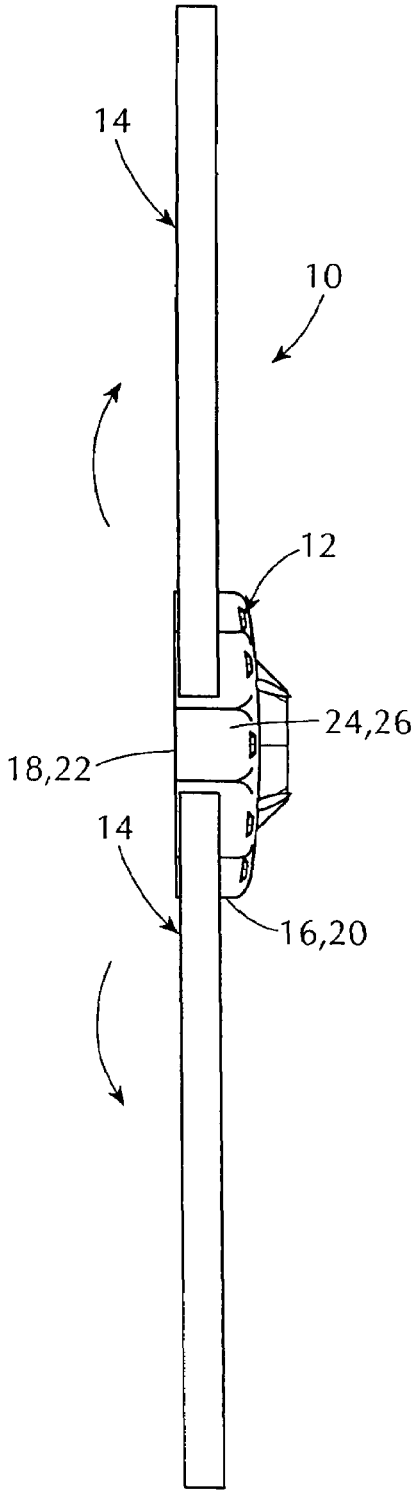
FIG. 7 is a diagrammatic side elevational view taken generally in the direction of ARROW 7 in FIG. 5.
Figure 8:
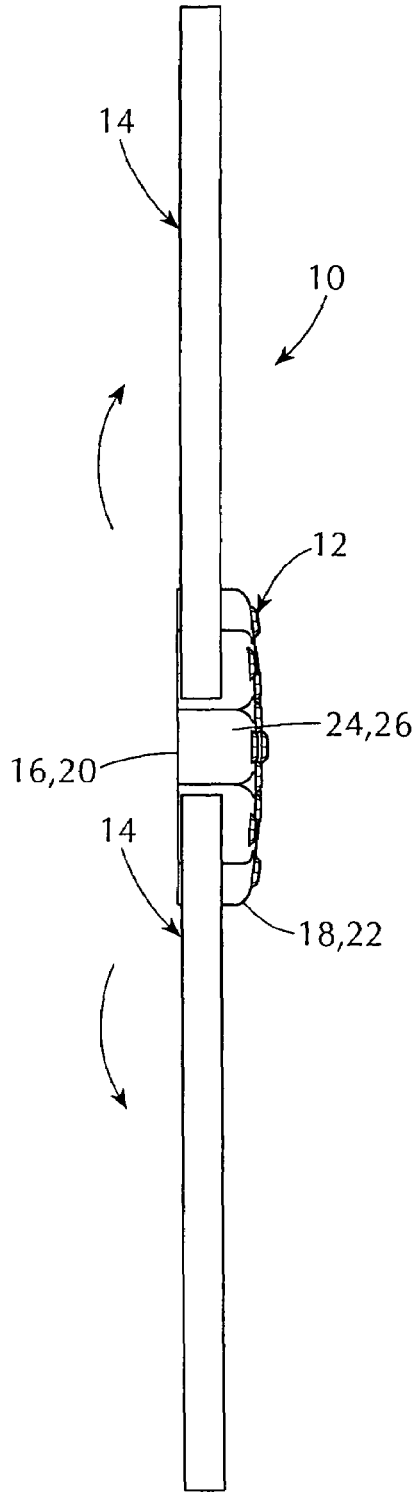
FIG. 8 is a diagrammatic side elevational view taken generally in the direction of ARROW 8 in FIG. 6.

The configuration of the reversible ring 10 can best be seen in FIGS. 1-8, which are, respectively, again a diagrammatic perspective view of the reversible ring of the embodiments of the present invention displaying a first display on a first side of the setting, a diagrammatic perspective view of the reversible ring of the embodiments of the present invention displaying a second display on a second side of the setting, a diagrammatic side elevational view taken generally in the direction of ARROW 3 in FIG. 1, a diagrammatic side elevational view taken generally in the direction of ARROW 4 in FIG. 2, a diagrammatic front elevation view of the reversible ring of the embodiments 9 of the present invention in an intermediate position and displaying the first display on the first side of the setting, a diagrammatic front elevation view of the reversible ring of the embodiments of the present invention in an intermediate position and displaying the second display on the second side of the setting, a diagrammatic side elevational view taken generally in the direction of ARROW 7 in FIG. 5, and a diagrammatic side elevational view taken generally in the direction of ARROW 8 in FIG. 6, and as such, will be discussed with reference thereto.

The reversible ring 10 comprises a setting 12 and at least one loop 14. The setting 12 has a first side 16 and a second side 18 that is opposite to the first side 16 of the setting 12.

The setting 12 shows a first display 20 on the first side 16 thereof and a second display 22 on the second side 18 thereof.

The at least one loop 14 is arrangeable for encircling the finger (not shown) of the wearer (not shown), is pivotally connected to the setting 12, and is rotatable between a first position and a second position.

The first display 20 is for positioning opposite to the finger (not shown) of the wearer (not shown) when the at least one loop 14 is in the first position thereof, and the second display 22 is for positioning opposite to the finger (not shown) of the wearer (not shown) when the at least one loop 14 is in the second position thereof.

The setting 16 further has a pair of stops 24. The pair of stops 24 of the setting 16 extend outwardly from sides 26 of the setting 16 and provide stops for the at least one loop 14 as the at least one loop 14 achieves the first position thereof or the second position thereof.

C. THE CONCLUSIONS

It will be understood that each of the elements described above or two or more together may also find a useful application in other types of constructions differing from the types described above.

While the embodiments of the present invention have been illustrated and described as embodied in a reversible ring for providing two rings in one for a finger of a wearer, however, they are not limited to the details shown, since it will be understood that various omissions, modifications, substitutions, and changes in the forms and details of the embodiments of the present invention illustrated and their operation can be made by those skilled in the art without departing in any way from the spirit of the embodiments of the present invention.

Without further analysis the foregoing will so fully reveal the gist of the embodiments of the present invention that others can by applying current knowledge readily adapt them for various applications without omitting features that from the standpoint of prior art fairly constitute characteristics of the generic or specific aspects of the embodiments of the present invention.

The invention claimed is:

1. A reversible ring for providing two rings in one for a finger of a wearer, comprising:

a) a setting; and b) at least one loop;

wherein said setting has a first side;

wherein said setting shows a first display on said first side thereof;

wherein said setting has a second side;

wherein said second side of said setting is opposite to said first side of said setting;

wherein said setting shows a second display on said second side of said setting;

wherein said at least one loop is arrangeable for encircling the finger of the wearer;

wherein said at least one loop is pivotally connected to said setting;

wherein said at least one loop is rotatable between a first position and a second position;

wherein said first display is for positioning opposite to the finger of the wearer when said at least one loop is in said first position thereof;

wherein said second display is for positioning opposite to the finger of the wearer when said at least one loop is in said second thereof;

wherein said setting has a pair of stops;

wherein said pair of stops extend outwardly from sides of said setting; and wherein said pair of stops provide stops for said at least one loop as said at least one loop achieves one of said first position thereof and said second position thereof.

* * * * *